US008458946B1

(12) United States Patent
Pintsch

(10) Patent No.: US 8,458,946 B1
(45) Date of Patent: Jun. 11, 2013

(54) BIPOD ADAPTER FOR FIREARM

(75) Inventor: Matas Victor Pintsch, Cresco, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/327,877

(22) Filed: Dec. 16, 2011

(51) Int. Cl.
*F41A 23/08* (2006.01)

(52) U.S. Cl.
USPC ..... 42/94; 42/90; 89/37.04

(58) Field of Classification Search
USPC ..... 42/90, 94; 89/37.03, 37.04
See application file for complete search history.

(56) References Cited

U.S. PATENT DOCUMENTS 4,017,997 A * 4/1977 Peterson et al. ..... 42/94
4,288,939 A * 9/1981 Beretta ..... 42/94
4,351,224 A * 9/1982 Curtis ..... 89/37.04
4,359,834 A * 11/1982 Beretta ..... 42/94
5,074,188 A * 12/1991 Harris ..... 89/37.04
2008/0052978 A1* 3/2008 Cahill ..... 42/90
2009/0000175 A1* 1/2009 Potterfield et al. ..... 42/94
2009/0064559 A1* 3/2009 Potterfield et al. ..... 42/94
2010/0218411 A1* 9/2010 Keng ..... 42/94
2011/0036236 A1* 2/2011 Potterfield et al. ..... 89/37.04
2011/0167703 A1* 7/2011 Deros ..... 42/90
2012/0085012 A1* 4/2012 Potterfield et al. ..... 42/94
2012/0144717 A1* 6/2012 Peterson et al. ..... 42/94

* cited by examiner

*Primary Examiner* — Bret Hayes
(74) *Attorney, Agent, or Firm* — Michael C. Sachs

(57) ABSTRACT

An adapter for connecting a bipod to a Picatinny rail of a firearm may include a base having upper and lower portions. The upper portion may include a generally planar surface with longitudinal edges. The lower portion may include a cylinder having a through bore. First and second support members may be disposed along the longitudinal edges. The first support member may define a female mating configuration of one side of the Picatinny rail. A locking bar may be detachably connected to the upper portion of the base. The locking bar may have an interior surface. A leaf spring may be fixed to an underside of the upper portion of the base. The interior surface of the locking bar and the second support member may define a female mating configuration of another side of the Picatinny rail.

11 Claims, 4 Drawing Sheets

BIPOD ADAPTER FOR FIREARM

STATEMENT OF GOVERNMENT INTEREST

The inventions described herein may be manufactured, used and licensed by or for the U.S. Government for U.S. Government purposes.

BACKGROUND OF THE INVENTION

The invention relates in general to rifle bipods and in particular to adapters for attaching bipods to rifles.

Some bipods, for example, a Harris bipod, may be designed to attach to a sling swivel stud that is fixed to a rifle. Many rifles, however, may not have a swing swivel stud. Some rifles may be equipped with a Picatinny rail. The Picatinny rail is a flattened bar having a major dimension much greater than its minor dimension and having a series of transverse grooves formed across the top of it. It has a cross section in the shape of a wide hexagon. The military standards for Picatinny rails are set forth in Military Standard 1913 entitled "Dimensioning of Accessory Mounting Rail for Small Arms Weapons" which is hereby incorporated by reference.

A bipod that is designed to attach to a sling swivel stud of a rifle may be attached to a rifle equipped with a Picatinny rail using a known adapter. However, the known adapter adds weight, cost and complexity to the combination of a bipod and a rifle with a Picatinny rail. In addition, the known adapter may raise the profile of the rifle, which makes the shooter more visible to hostile parties.

A long-felt and unsolved need exists for a lighter, cheaper, less complex, and lower profile apparatus and method for interfacing a bipod and a rifle having a Picatinny rail.

SUMMARY OF THE INVENTION

It is an object of the invention to provide an apparatus and method for interfacing a bipod and a rifle having a Picatinny rail.

One aspect of the invention is an adapter for connecting a bipod to a Picatinny rail of a firearm. The adapter may include a base having an upper portion and a lower portion. The upper portion may include a generally planar surface with longitudinal edges. The lower portion may include a cylinder having a through bore. A first support member may be disposed along one of the longitudinal edges of the generally planar surface. The first support member may have an interior surface that defines a female mating configuration of one side of the Picatinny rail.

A second support member may be disposed along an opposite longitudinal edge of the generally planar surface. The second support member may have an interior surface and an exterior surface. A locking bar may be detachably connected to the upper portion of the base. The locking bar may have an interior surface with upper and lower portions. The lower portion of the interior surface of the locking bar may be substantially contiguous with the exterior surface of the second support member. A leaf spring may be fixed to an underside of the upper portion of the base. The upper portion of the interior surface of the locking bar and the interior surface of the second support member may define a female mating configuration of another side of the Picatinny rail.

The leaf spring may include a base portion and two opposing, generally L-shaped portions. The base portion may be fixed to the underside of the upper portion of the base. A rivet may extend through the generally planar surface of the upper portion of the base and the base portion of the leaf spring.

Offset from the rivet, a roll pin may be fixed to the upper portion of the base and may extend through the base portion of the leaf spring.

A shaft may extend through the base and the locking bar. A torque nut may threadingly engage the shaft. A torque knob may engage the torque nut. A pair of alignment pins may extend from the base through the locking bar. A fastener may extend through the upper portion of the base and the locking bar.

Another aspect of the invention is an apparatus that may include a bipod having a mounting cylinder with a slot and an adapter for connecting the bipod to a Picatinny rail of a firearm. The mounting cylinder of the bipod may be rotatably disposed in the through bore of the cylinder of the adapter. A second shaft may extend through the mounting cylinder of the bipod. A washer with a slotted opening may be disposed on the second shaft. A pin may extend transversely through one end of the second shaft. The pin may engage the slot of the mounting cylinder. The pin may have a size larger than a size of the slotted opening in the washer. A nut may threadingly engage another end of the second shaft.

A further aspect of the invention is a firearm having a Picatinny rail and a bipod mounted thereon, and an adapter that interfaces between the Picatinny rail and the bipod.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
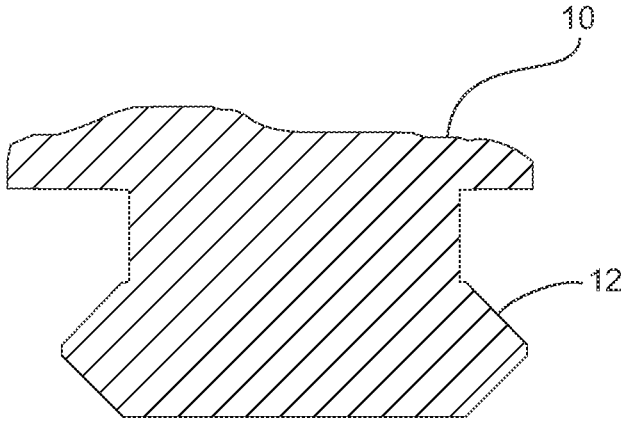
Fig. 1 Prior Art
FIG. 1 is a partial sectional view of a firearm with a Picatinny rail mounted on a bottom surface thereof.
Figure 2:
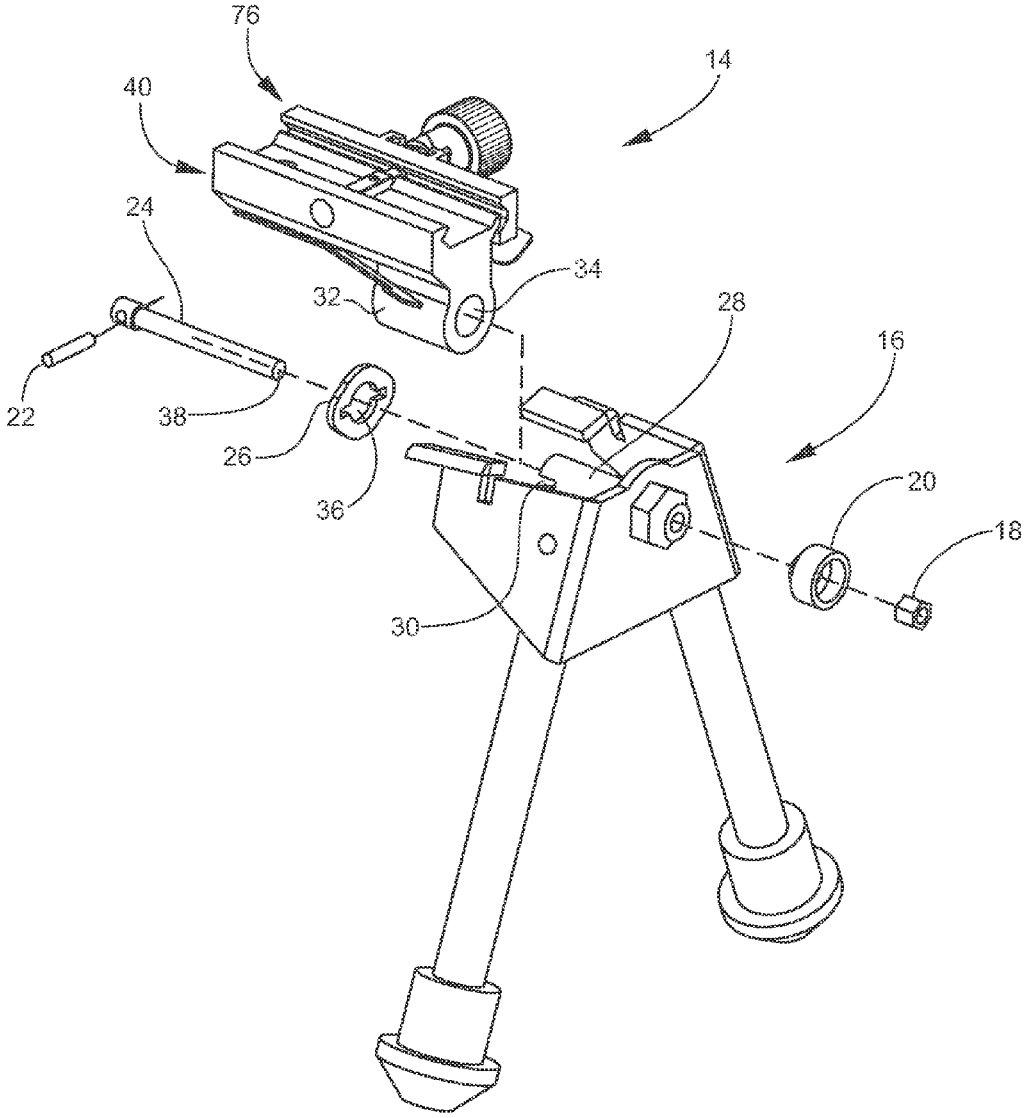
FIG. 2 is an exploded perspective view of a bipod adapter and a bipod for use with the firearm of FIG. 1.

FIG. 1 is a partial sectional view of a firearm 10 with a Picatinny rail 12 mounted on a bottom surface thereof. FIG. 2 is an exploded view of one embodiment of a bipod adapter 14 and a bipod 16 for use with firearm 10. Bipod 16 may be, for example, a modified Harris bipod. Adapter 14 may enable bipod 16 to be fixed to rail 12. Bipod 16 may not include a sling swivel adapter, thereby reducing the weight, cost, complexity, and profile of firearm 10 and bipod 16.

A commercial off-the-shelf (COTS) bipod may include a sling swivel adapter. The COTS bipod may be, for example, a Harris bipod. Referring to FIG. 2, a sling swivel adapter may be removed from a COTS bipod by loosening nut 18 and adjust nut 20 from shaft 24, removing pin 22 from shaft 24, and removing shaft 24 and washer 26. Then, the sling swivel adapter (not shown) may slide off of mounting cylinder 28.

Adapter 14 may be installed on bipod 16 by sliding cylinder 32 having through bore 34 over mounting cylinder 28. Cylinder 32 may be rotatable on mounting cylinder 28. Washer 26 having slotted opening 36 may be placed over mounting cylinder 28. Pin 22 may be inserted in shaft 24 and shaft 24 may be inserted through washer 26 and mounting cylinder 28. Adjust nut 20 and nut 18 may be threaded on end 38 of shaft 24. Pin 22 may be larger than slotted opening 36 in washer 26 to prevent shaft 24 from passing completely through slotted opening 36. Pin 22 may rest in slot 30 in mounting cylinder 28.

Figure 3:
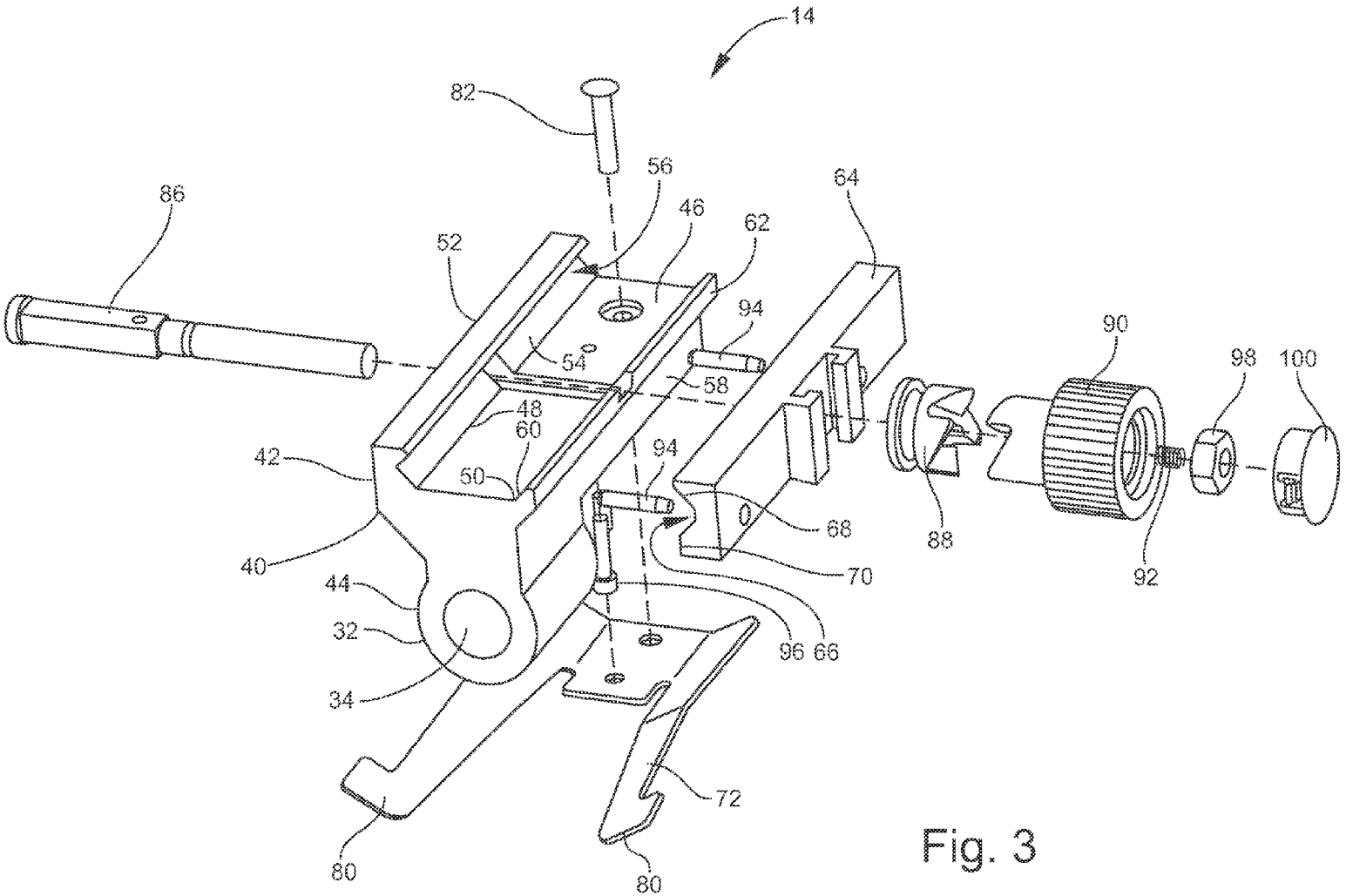
FIGS. 3 and 4 are exploded perspective views of the bipod adapter of FIG. 2.
Figure 4:
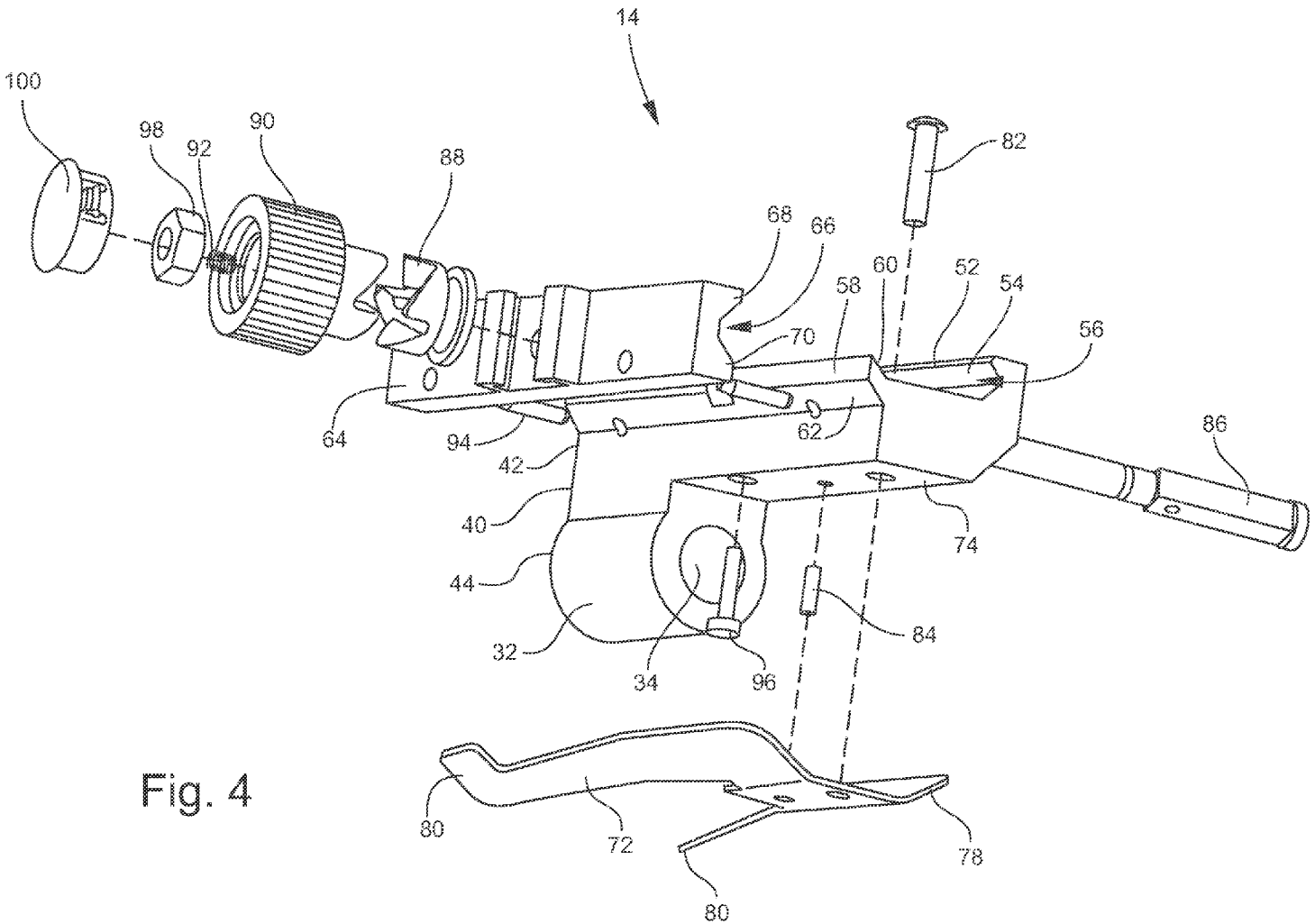

FIGS. 3 and 4 are exploded perspective views of adapter 14. Adapter 14 may include a base 40 having an upper portion 42 and a lower portion 44. Upper portion 42 may include a generally planar surface 46 with longitudinal edges 48, 50. Lower portion 44 may include a cylinder 32 having a through bore 34. A first support member 52 may be disposed along longitudinal edge 48 of generally planar surface 46. First support member 52 may have an interior surface 54 that defines a female mating configuration 56 of one side of Picatinny rail 12.

A second support member 58 may be disposed along opposite longitudinal edge 50 of generally planar surface 46. Second support member 58 may have an interior surface 60 and an exterior surface 62. A locking bar 64 may be detachably connected to second support member 58. Locking bar 64 may have an interior surface 66 with upper and lower portions 68, 70. Lower portion 68 of interior surface 66 of locking bar 64 may be substantially contiguous with exterior surface 62 of second support member 58 when locking bar 64 is an the locked position shown in FIG. 2. Upper portion 68 of interior surface 66 of locking bar 64 and interior surface 60 of second support member 58 may define a female mating configuration 76 (FIG. 2) of another side of Picatinny rail 12.

A leaf spring 72 may be fixed to an underside 74 of upper portion 42 of base 40. Leaf spring 72 may be a known leaf spring that may be used with a COTS bipod having a sling swivel connection. Leaf spring 72 may include a base portion 78 and two opposing, generally L-shaped portions 80. Base portion 78 may be fixed to underside 74 of upper portion 42 of base 40.

A rivet 82 may extend through generally planar surface 46 of upper portion 42 of base 40 and through base portion 78 of leaf spring 72. Leaf spring 72 may be rotatable about rivet 82. Offset from rivet 82 may be a roll pin 84. Roll pin 84 may be fixed to upper portion 42 of base 40 and may extend through base portion 78 of leaf spring 72. Roll pin 84 may prevent rotation of leaf spring 72 about rivet 82.

A shaft 86 may extend through base 40 and locking bar 64. A torque nut 88 may be threadingly engaged with shaft 86 and a torque knob 90 may be engagable with torque nut 88 to thereby tighten locking bar 64 to upper portion 42 of base 40. A spring 92 may be disposed between torque knob 90 and a threaded nut 98 disposed on shaft 86. Compression of spring 92 may be varied by adjusting nut 98 to thereby prevent over-tightening or under-tightening of locking bar 64. A cover 100 may be placed over nut 98. A pair of alignment pins 94 may extend from base 40 through locking bar 64. A fastener 96, for example, a threaded fastener, may extend through upper portion 42 of base 40 and into locking bar 64 to secure locking bar 64 in place.

After adapter 14 is attached to bipod 16 as described above, locking bar 64 may be loosened and adapter 14 fitted to Picatinny rail 12. Locking bar 64 may be tightened such that female mating configurations 56, 76 engage opposite sides of rail 12.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An adapter for connecting a bipod to a Picatinny rail of a firearm, the adapter comprising:

a base having an upper portion and a lower portion, the upper portion including a generally planar surface with longitudinal edges, the lower portion including a cylinder having a through bore;

a first support member disposed along one of the longitudinal edges of the generally planar surface, the first support member having an interior surface that defines a female mating configuration of one side of a Picatinny rail;

a second support member disposed along an opposite longitudinal edge of the generally planar surface, the second support member having an interior surface and an exterior surface;

a locking bar detachably connected to the upper portion of the base, the locking bar having an interior surface with upper and lower portions, the lower portion of the interior surface of the locking bar being substantially contiguous with the exterior surface of the second support member; and a leaf spring fixed to an underside of the upper portion of the base;

wherein the upper portion of the interior surface of the locking bar and the interior surface of the second support member define a female mating configuration of another side of a Picatinny rail.

2. The adapter of claim 1, wherein the leaf spring includes a base portion and two opposing, generally L-shaped portions, the base portion being fixed to the underside of the upper portion of the base.

3. The adapter of claim 2, further comprising a rivet extending through the generally planar surface of the upper portion of the base and the base portion of the leaf spring and, offset from the rivet, a roll pin fixed to the upper portion of the base and extending through the base portion of the leaf spring.

4. The adapter of claim 3, further comprising a shaft extending through the base and the locking bar, a torque nut threadingly engaged with the shaft and a torque knob in engagement with the torque nut.

5. The adapter of claim 4, further comprising a pair of alignment pins extending from the base through the locking bar.

6. The adapter of claim 5, further comprising a fastener extending through the upper portion of the base and the locking bar.

7. An apparatus, comprising:

a bipod having a mounting cylinder with a slot;

the adapter of claim 1;

the mounting cylinder of the bipod being rotatably disposed in the through bore of the cylinder of the adapter;

a second shaft extending through the mounting cylinder of the bipod;

a washer with a slotted opening disposed on the second shaft;

a pin extending transversely through one end of the second shaft, the pin engaging the slot of the mounting cylinder, the pin having a size larger than a size of the slotted opening in the washer; and a nut threadingly engaged with another end of the second shaft.

8. An apparatus, comprising:

a firearm having a Picatinny rail mounted thereon; and the apparatus of claim 7;

wherein the first support member engages one side of the Picatinny rail, and the second support member and the locking bar engage another side of the Picatinny rail.

9. A method of attaching a bipod to a Picatinny rail of a firearm, comprising:

providing the adapter of claim 1;

mounting the adapter to the bipod; and engaging one side of the Picatinny rail with the first support member and engaging another side of the Picatinny rail with the second support member and the locking bar.

10. An adapter for connecting a bipod to a Picatinny rail of a firearm, the adapter comprising:

a base having an upper portion and a lower portion, the upper portion including a generally planar surface with longitudinal edges, the lower portion including a cylinder having a through bore;

a first support member disposed along one of the longitudinal edges of the generally planar surface, the first support member having an interior surface that defines a female mating configuration of one side of a Picatinny rail;

a second support member disposed along an opposite longitudinal edge of the generally planar surface, the second support member having an interior surface and an exterior surface;

a locking bar detachably connected to the upper portion of the base, the locking bar having an interior surface with upper and lower portions, the lower portion of the interior surface of the locking bar being substantially contiguous with the exterior surface of the second support member;

a leaf spring fixed to an underside of the upper portion of the base, the leaf spring including a base portion and two opposing, generally L-shaped portions, the base portion being fixed to the underside of the upper portion of the base;

a rivet extending through the generally planar surface of the upper portion of the base and the base portion of the leaf spring and, offset from the rivet, a roll pin fixed to the upper portion of the base and extending through the base portion of the leaf spring;

a shaft extending through the base and the locking bar;

a torque nut threadingly engaged with the shaft;

a torque knob in engagement with the torque nut;

a pair of alignment pins extending from the base through the locking bar; and a fastener extending through the upper portion of the base and the locking bar;

wherein the upper portion of the interior surface of the locking bar and the interior surface of the second support member define a female mating configuration of another side of a Picatinny rail.

11. An apparatus, comprising:

a bipod having a mounting cylinder with a slot;

the adapter of claim 10;

the mounting cylinder of the bipod being rotatably disposed in the through bore of the cylinder of the adapter;

a second shaft extending through the mounting cylinder of the bipod;

a washer with a slotted opening disposed on the second shaft;

a pin extending transversely through one end of the second shaft, the pin engaging the slot of the mounting cylinder, the pin having a size larger than a size of the slotted opening in the washer; and a nut threadingly engaged with another end of the second shaft.

* * * * *